US005896670A

United States Patent [19]

Gibson et al.

[11] Patent Number: 5,896,670

[45] Date of Patent: Apr. 27, 1999

[54] CHAIN TENSIONER FOR CHAIN SAW

[75] Inventors: Duane M. Gibson, Milwaukie; Arvin A. Hille, West Linn; Kent L. Huntington, Molalla; Johann Weber, Estacada, all of Oreg.

[73] Assignee: Blount, Inc., Portland, Oreg.

[21] Appl. No.: 08/900,231

[22] Filed: Jul. 24, 1997

[51] Int. Cl.[6] ..... B27B 17/14

[52] U.S. Cl. ..... 30/386; 83/816

[58] Field of Search ..... 30/386, 383, 381, 30/385; 83/816

[56] References Cited

U.S. PATENT DOCUMENTS

| | | | |
|---|---|---|---|
| 2,289,123 | 7/1942 | Jones . | |
| 2,532,981 | 12/1950 | Wolfe . | |
| 2,765,821 | 10/1956 | Strunk . | |
| 2,774,395 | 12/1956 | Tweedie . | |
| 3,267,973 | 8/1966 | Beard | 30/386 |
| 3,327,741 | 6/1967 | Merz | 30/386 |
| 3,382,898 | 5/1968 | Walker . | |
| 3,457,970 | 7/1969 | Locati . | |
| 3,636,995 | 1/1972 | Newman . | |
| 3,647,270 | 3/1972 | Althaus . | |
| 3,866,320 | 2/1975 | Progi | 30/386 |
| 3,901,563 | 8/1975 | Day . | |
| 4,129,943 | 12/1978 | Bricker | 30/386 |
| 4,269,099 | 5/1981 | Saito . | |
| 4,316,327 | 2/1982 | Scott | 30/386 |
| 4,361,960 | 12/1982 | Halverson | 30/385 |
| 4,382,344 | 5/1983 | Reynolds | 30/386 |
| 4,486,953 | 12/1984 | Halverson | 30/385 |
| 4,563,817 | 1/1986 | Leighton | 30/386 |
| 4,567,658 | 2/1986 | Wissmann | 30/386 |
| 4,819,335 | 4/1989 | Alexander | 30/386 |
| 4,835,868 | 6/1989 | Nagashima | 30/386 |
| 4,920,650 | 5/1990 | Edlund | 30/386 |
| 4,999,918 | 3/1991 | Schliemann | 30/386 |
| 5,070,618 | 12/1991 | Edlund | 30/386 |
| 5,174,029 | 12/1992 | Talberg | 30/386 |
| 5,491,899 | 2/1996 | Schliemann | 30/386 |
| 5,497,557 | 3/1996 | Martinsson | 30/386 |
| 5,528,835 | 6/1996 | Ra | 30/386 |

FOREIGN PATENT DOCUMENTS 1329-966 3/1985 U.S.S.R. .

*Primary Examiner*—Hwei-Siu Payer
*Attorney, Agent, or Firm*—Robert L. Harrington

[57] ABSTRACT

A chain tensioner for a chain saw has a cam member in positive engagement with a flange of a plate attached to the guide bar. Rotation of the cam member forces the guide bar away from a drive sprocket of the chain saw to tension the chain. The cam member is clamped in position to maintain the guide bar in the adjusted position. Flats on the cam member in abutment with the flange resist rotation of the cam member when in the adjusted and clamped position. A slot is provided in the cam member to facilitate rotating the cam to force the guide bar away from the drive sprocket.

7 Claims, 3 Drawing Sheets

CHAIN TENSIONER FOR CHAIN SAW

FIELD OF THE INVENTION

This invention relates to a mechanism for mounting a guide bar and chain to a power head of a chain saw and more particularly it relates to that mechanism which achieves proper tensioning of the chain on the guide bar.

BACKGROUND OF THE INVENTION

A chain saw includes a power head having a drive shaft that drives a sprocket and a guide bar having a peripheral guide edge. The guide bar is mounted relative to the sprocket so that a loop of saw chain is guided in a path from the sprocket onto the guide edge of the bar (a groove in the periphery of the bar). The guide path continues around the nose of the bar in an oval-like pathway that leads back along the opposite side edge of the bar and back onto the sprocket. Because of the forces applied during cutting, the chain is required to tightly fit around the sprocket and guide bar to avoid having the chain jump free of the sprocket and/or bar edge.

Typically the bar is mounted so as to have limited sliding movement toward and away from the sprocket. A screw and nut assembly on the power head controls the sliding movement and a clamping member clamps the relative position of the bar when the desired tension is obtained.

When mounting a chain onto the bar and sprocket, the clamping member is loosened and the screw and nut assembly is manipulated first to allow mounting of the chain and then to tension the chain, at which position the clamping member clamps the bar in that position relative to the sprocket. Unfortunately that is not the end of the tensioning procedure. During operation of the chain saw, the chain develops slack either due to stretching and/or wearing of the components or perhaps due to some slipping of the bar relative to the clamping member. Repeatedly during operation of the chain saw, the operator will have to stop cutting, un-clamp the clamping member, manipulate the screw and nut assembly (typically located on the opposite side of the bar) and re-clamp the clamping member.

As consumer saws have become more and more popular (as compared to professional saws used by loggers), the process of chain tensioning has become more of a problem for the operator. The operator often doesn't remember the process or will attempt manipulation of the screw and nut assembly without releasing the clamping member. This can result in stripping the threads or otherwise damaging the assembly. At the least, the process is seen to be time consuming and a source of frustration to the consumer/operator. It is accordingly an object of the present invention to simplify the chain tensioning procedure to make it safer and more convenient without adding significant cost to the manufacture of the chain saw.

BRIEF DESCRIPTION OF THE INVENTION

The present invention accomplishes the above-stated objective by combining the clamping and tensioning mechanisms (the tensioning mechanism of the invention replacing the above-described screw and nut assembly). Although not described above, the clamping mechanism on typical chain saws includes a pair of mounting studs that fit through elongated slots in the bar (thus allowing sliding adjustment). The studs are threaded and a clamping nut is threaded onto each stud and when the saw chain is appropriately tensioned, the clamping nuts are cinched down against the bar.

In the preferred embodiment of the invention, one of the studs is used only for alignment, i.e., in cooperation with the second stud it allows linear sliding movement only of the bar. The second stud is provided with a cam member which may resemble a washer having an off center, stud receiving opening. With respect to a particular segment of the periphery of the washer, the distance from the stud gradually increases. A bearing surface or shoulder affixed to the bar engages the periphery of the cam member at the point on the periphery that is positioned outwardly from the sprocket. Turning the cam so that the shortest distance of that segment of the periphery is engaging the bearing surface, allows retraction of the bar and mounting of the saw chain. Turning of the cam to thereby increase the distance of the contact point from the stud forces outward sliding movement of the bar and thereby tensioning of the chain. Such turning is preferably facilitated by the provision of a tool such as a screwdriver, the cam member being provided with a slot for receiving the blade end of the screwdriver and whereby turning of the screwdriver induces turning of the cam member.

In one embodiment, a separate plate is mounted between the clamping nut and the bar, the plate having a projecting finger projected into a hole provided in the bar. A typical guide bar is provided with oil holes that can serve this purpose. With the finger projected in the hole (e.g., an oil hole), the plate is fixed linearly relative to the bar and forced sliding movement of the plate results in similar forced sliding movement of the bar. The plate has a flange (a bearing surface) against which the cam member is engaged. Other embodiments are envisioned, e.g., with a flange provided integrally with the bar; with the bearing surface provided as an indentation or slot; and so on.

Again for the preferred embodiment, the periphery of the cam member is formed by short intersecting flat edges or other configurations that initiate seating of the cam member against the flange at sequential positions on the periphery.

A prior art saw chain tensioner is illustrated in U.S. Pat. No. 5,491,899. The mechanism of this patent is designed for finger (tool less) manipulation whereby an oversized camming member having a helical slot enables extensive rotative turning of the member, preferably 360 degrees to 450 degrees. The mechanism is more complex and adds undesired cost. The present invention excels in its simplicity and lower cost and will be more fully appreciated by reference to the following detailed description and the drawings referred to therein.

DESCRIPTION OF THE PREFERRED EMBODIMENT

Figure 1:
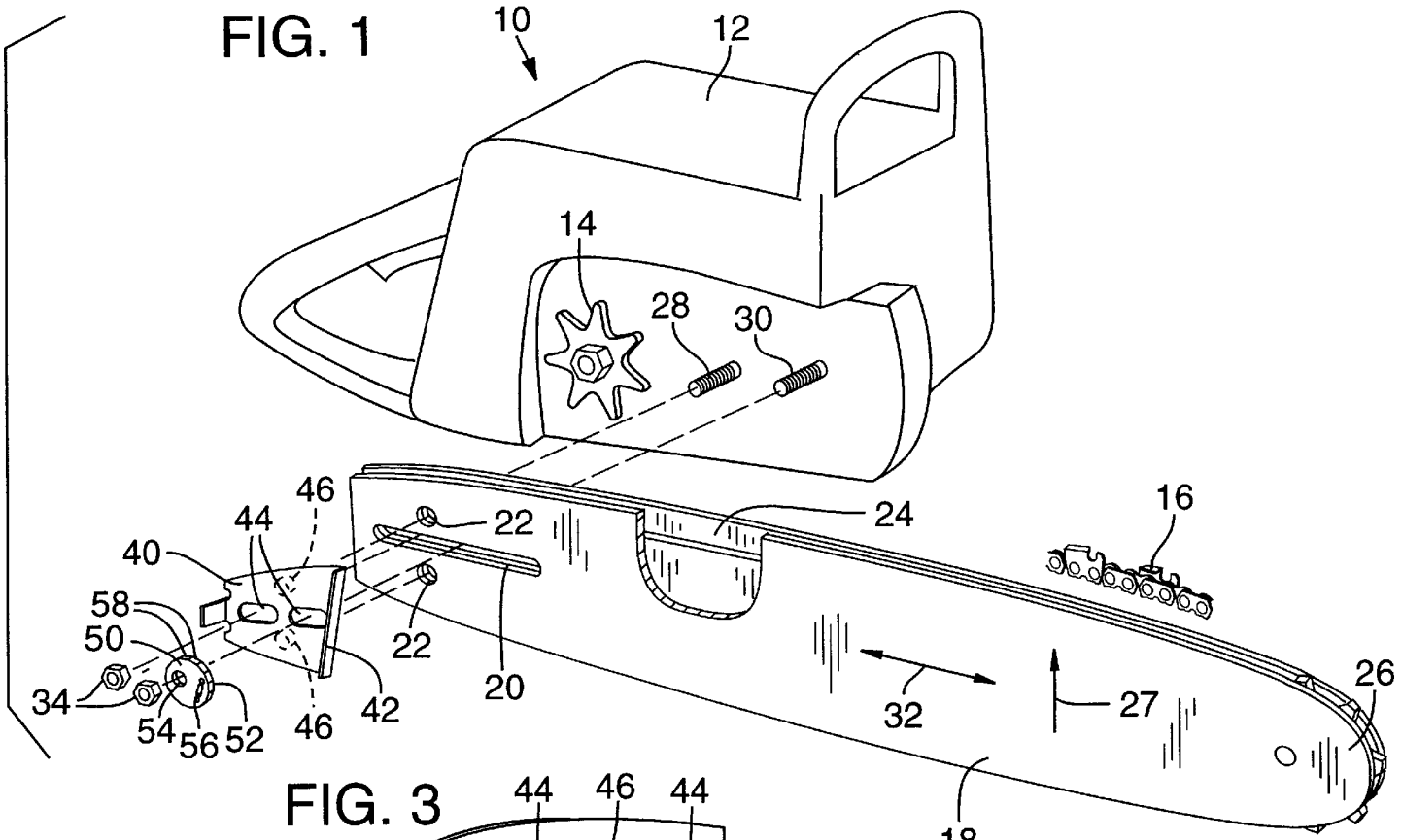
FIG. 1 is an exploded view of a chain saw incorporating a chain tensioner of the present invention.
Figure 2:
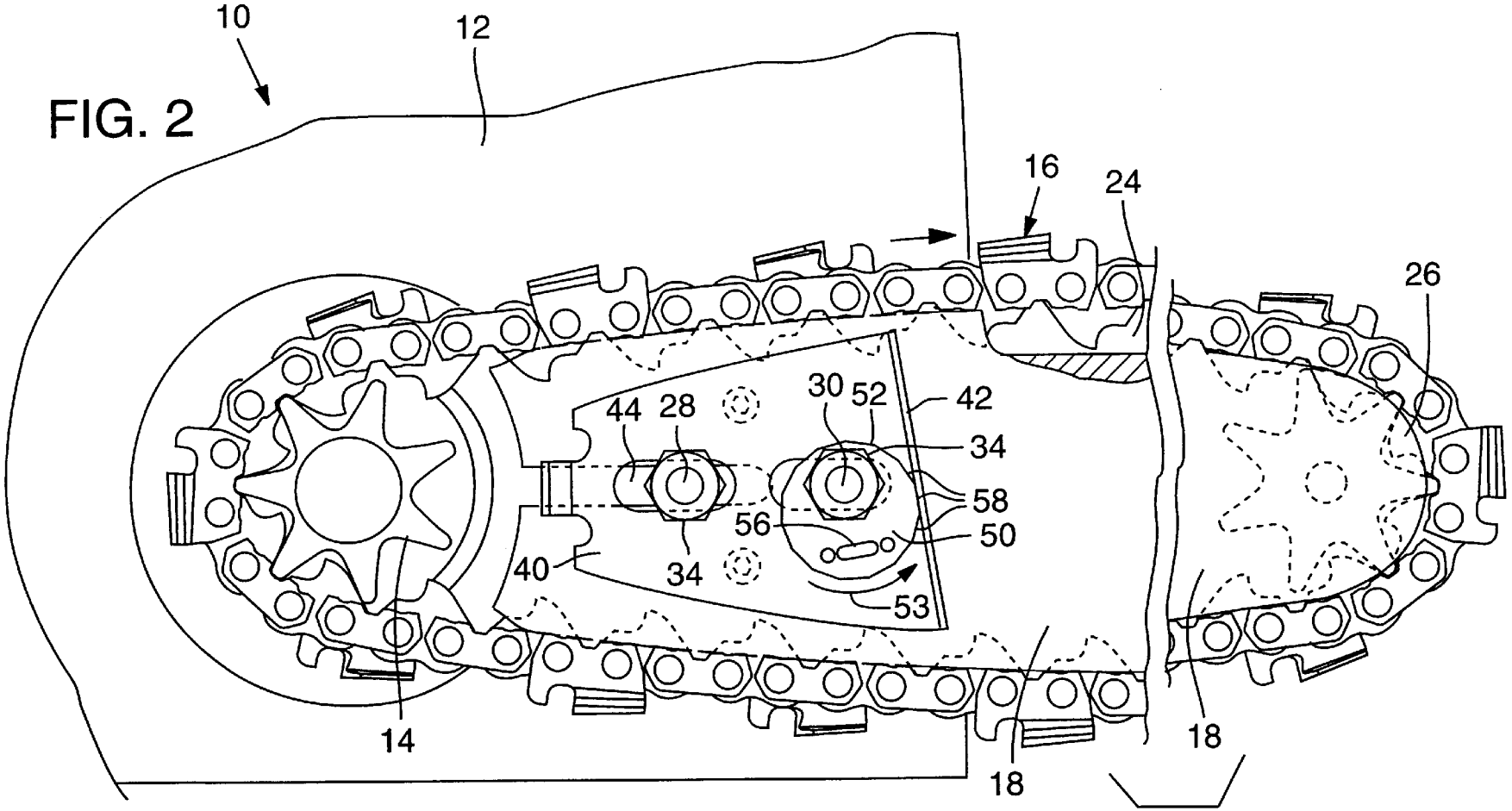
FIG. 2 is a view of a portion of the chain saw of FIG. 1 illustrating the chain tensioner installed.

FIGS. 1 and 2 illustrate a chain saw 10 incorporating a chain tensioner of the present invention. The saw 10 has a housing 12 which incorporates a conventional motor which drives a drive sprocket 14. The drive sprocket 14 is arranged to propel an endless saw chain 16 around a guide bar 18. The guide bar 18 has a conventional guide groove 24 around the periphery in which the drive tangs of the saw chain 16 will travel as it is being propelled by the drive sprocket 14. The guide bar 18 is mounted to the housing 12 on studs 28 and 30 that extend from the housing 12. The guide bar 18 has a slot 20 (best seen in FIG. 1) that has a width that corresponds closely to the diameter of the studs 28, 30 with the slot 20 permitting sliding adjustment of the guide bar 18 along the studs 28, 30 as indicated by directional arrow 32. Typically the studs 28, 30 are threaded to receive clamping nuts 34. The clamping nuts 34 are utilized to clamp the guide bar 18 against the housing 12. The guide bar 18 has oil holes 22 to provide lubrication to the saw chain 16 and the guide groove 24 of the guide bar in a conventional manner. As will be explained, these oil holes 22 also serve as adjusting holes. Use of the same holes as both oil holes and adjusting holes is a benefit of the preferred embodiment but the provision of separate holes for such use is contemplated.

Initially the guide bar 18 is loosely mounted on the studs 28, 30 and is moved toward the drive sprocket 14 to permit mounting the saw chain 16 on the guide bar 18 and the drive sprocket 14. When the saw chain 16 is entrained around the drive sprocket 14 and the guide bar 18, the guide bar 18 is moved away from the drive sprocket 14 (with nose 26 of the guide bar 18 being lifted upwardly as indicated by arrow 27) to thus tension the saw chain 16 on the guide bar 18 and the drive sprocket 14. When the guide bar 18 has been moved outwardly a sufficient distance to provide the proper tension for operation of the saw chain 16, the guide bar 18 is secured in the adjusted position.

The chain tensioner of the present invention has a mechanism that will move the guide bar 18 outwardly from the drive sprocket 14 to the desired adjusted position and will maintain the guide bar 18 in that position. In this embodiment, the guide bar 18 is mounted on the studs 28, 30 as previously mentioned. The chain tensioner of the present invention has a plate 40 that is mounted on the studs 28, 30 adjacent to the guide bar 18. The plate 40 has projecting fingers 46 (studs) that engage the oil/adjusting holes 22 of the guide bar 18. The fingers 46 engaging the holes 22 couples the guide bar 18 and the plate 40 together so that the plate 40 and the guide bar 18 will move as a unit.

A cam member 50 is rotatably mounted on the stud 30 adjacent to the plate 40 and is arranged to engage a flange 42 of the plate 40. The nut 34 is loosely mounted on the stud 30 to hold the assembly on the studs 28, 30. The cam member 50 is initially installed such that the guide bar 18 may be moved toward the drive sprocket 14. With the guide bar moved toward the sprocket 14, the saw chain is entrained around the guide bar 18 and the drive sprocket 14.

Rotation of the cam member 50 forces the peripheral edge 52 of the cam member 50 against the flange 42 of the plate 40 causing the plate 40 and the guide bar 18 to move away from the drive sprocket 14. The cam member 50 is preferably mounted on the stud 30 such that rotation of the cam member in the direction indicated by arrow 53 in FIG. 2 will engage the flange 42 below the center line defined by studs 28, 30 and move the guide bar away from the drive sprocket 14. Whereas the cam action will provide the tensioning function in either clockwise or counter clockwise rotation of the cam member 50, the counter clockwise rotation (arrow 53 in FIG. 2) produces a lifting action against the nose end of the bar which is desirable. In a clockwise rotation of the cam member 50, the engagement with flange 42 will be above the center line defined by studs 28, 30 and a downward force vector will result. In this case it may be desirable to provide independent lifting of the nose end of the bar during tensioning.

The cam member has multiple flats 58 on its peripheral edge 52 and one of the flats 58 will be in abutment with the flange 42. When the bar 18 is moved outwardly to the desired adjusted position (including moving the nose 26 of the bar 18 upwardly as indicated by arrow 27), the nut 34 is tensioned on stud 30. Tensioning the nut 34 clamps the cam member 50, the plate 40 and the guide bar 18 against the housing 12. In addition to the clamping force of the nut 30, the peripheral edge 52 (a flat 58) of the cam member 50 is in contact with the flange 42 of the plate 40 to further prevent the guide bar 18 from moving toward the drive sprocket 14.

As illustrated, the stud 28 may also have a nut 34 threadably installed to enhance clamping but such is not deemed essential. Alternatively, stud 28 is utilized merely as a guide member for the guide bar 18. It has been found that the flat 58 of the cam member 50 acting against the flange 42 of the plate 40 and the cam member 50 being clamped in position on the stud 30 by the nut 34 is adequate to maintain the guide bar 18 in the adjusted position.

Figure 3:
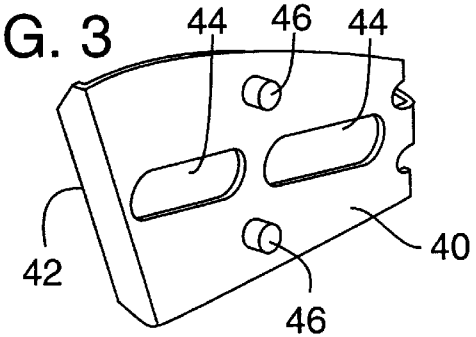
FIG. 3 is an enlarged view of the adjusting plate shown in FIG. 1 but from the opposite side.

The guide plate 40 is further illustrated in FIGS. 1 and 3. Note that FIG. 3 illustrates plate 40 from the side hidden from view in FIG. 1. As shown, the guide plate 40 is a substantially flat member having an extending right angle leg or flange 42. The plate 40 has centrally positioned slots 44 sufficiently long to be adjusted along the studs 28, 30 in the same manner as the guide bar 18. The plate 40 is mountable on the studs 28, 30 with the studs 28, 30 being received in the slots 44. Extending fingers 46 (studs) extend from the plate 40 (on the opposite side of the flange 42 as seen in FIG. 1). The studs 46 are positioned such that one stud 46 will fit into each of the oil holes 22 of the guide bar 18 when the plate 40 is mounted adjacent the guide bar 18.

Figure 4:
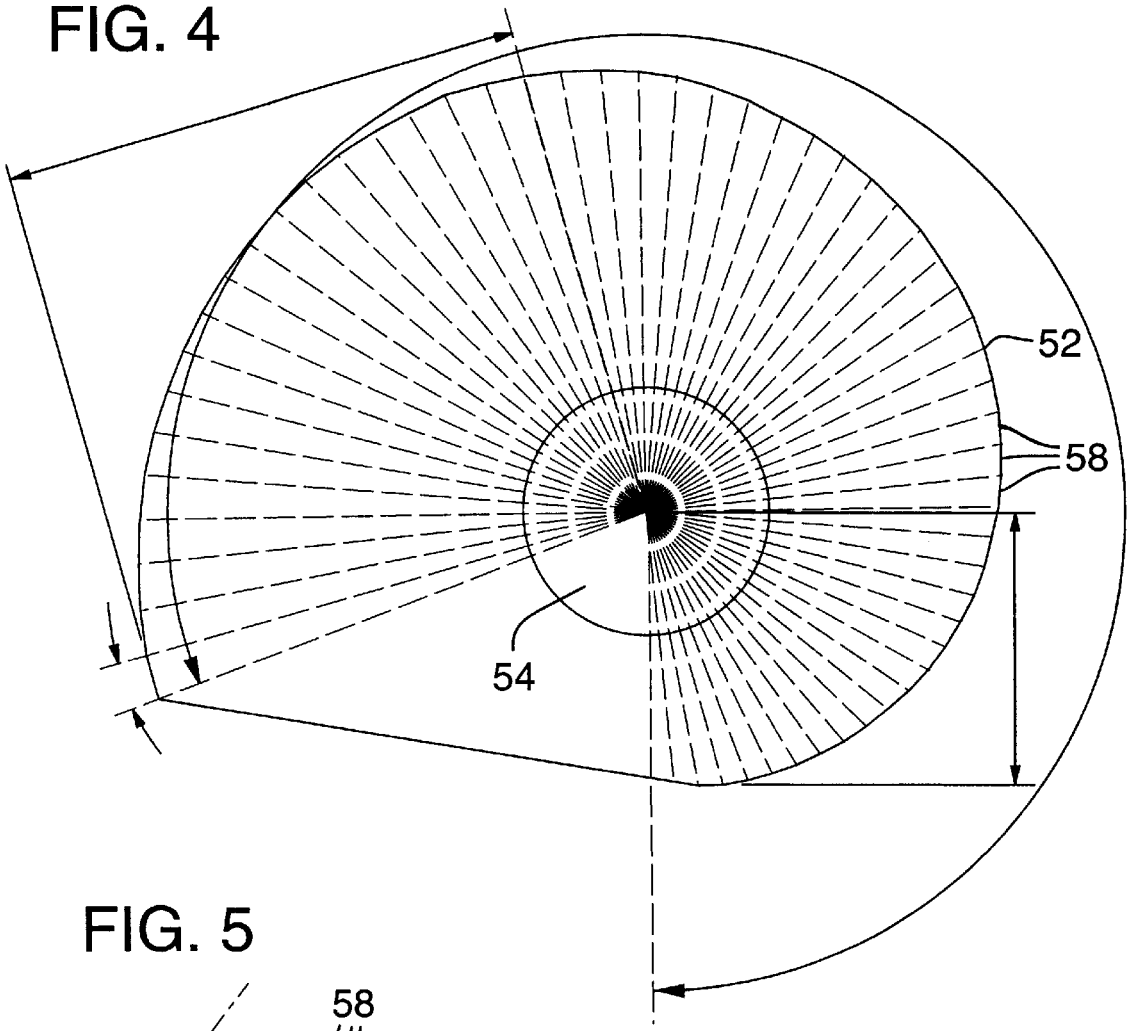
FIG. 4 is a view of a layout for an adjusting cam.
Figure 5:
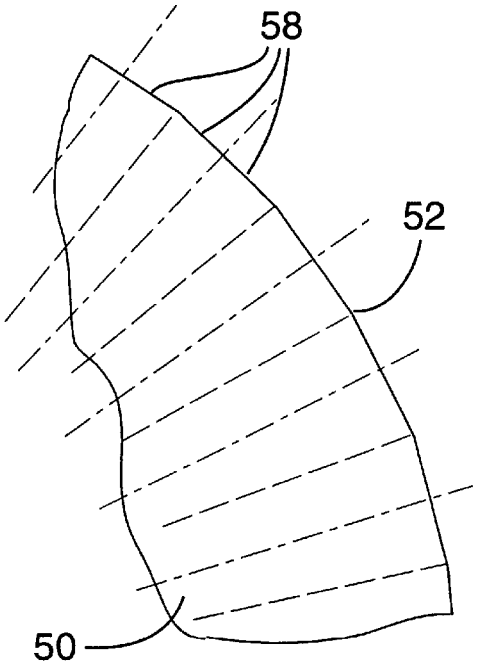
FIG. 5 is an enlarged view of a portion of the adjusting cam of the chain tensioner of FIGS. 1 and 2.

The cam member 50 is illustrated in FIGS. 1, 2, and 5 with FIG. 5 being an enlarged view of a portion of the periphery 52 of the cam member 50. The cam member 50 has a peripheral edge 52 that varies in distance from a center of a stud receiving hole 54. An example of a layout for the cam member 50 is illustrated in FIG. 4. A peripheral edge 52 extends at a distance from the center of the hole 54 in a spiral-like fashion such that the peripheral edge 52 varies in distance from the center of the hole 54. Preferably the peripheral edge 52 has generated flats 58 such as shown in the enlarged view of FIG. 5. Each flat 58 is at a different distance from the center of the hole 54 with the differential distance between adjoining flats being about 0.005 inch.

A tool receiving slot 56 is provided in the surface of the cam member 50 as best seen in FIG. 2. A tool such as a tip of a flat bladed screw driver inserted in the slot 56 is utilized to rotate the cam member 50 when installed on the stud 30. The slot 56 is at a sufficient distance from the hole 54 so that the nut 34 when installed on the stud 30 does not cover or interfere with usage of the slot 56.

Figure 6:
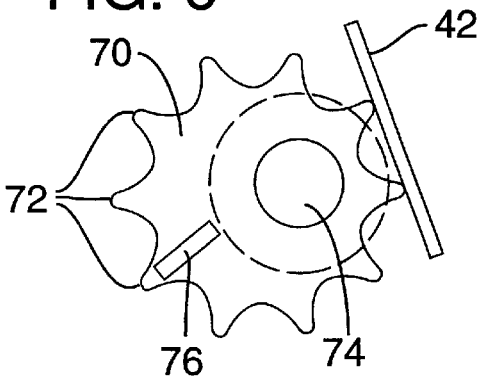
FIG. 6 is a view of an alternate adjusting cam.

The cam member may have different profiles than that illustrated for the cam member 50. An example of one variation is illustrated in FIG. 6. As shown a cam member 70 is a spiral-like wheel that has extending spokes 72 on its periphery that are at different distances from the center of a stud receiving hole 74. The distances from the center of the hole 74 to adjacent spokes 72 is an incremental distance. The cam member has a slot 76 to receive a tool such as a blade of a screw driver, the tool being utilized to rotate the cam member 70 when installed on the stud 30 of the chain saw 10.

In use the cam member 70 is rotated such that two adjacent spokes 72 will be in contact with the flange 42 of the plate 40. The two spokes 72 in contact with the flange 42 will resist rotation of the cam member 70.

It will be appreciated that the cam member utilized with the chain tensioner may have profiles and configurations other than those illustrated and described.

The procedure for mounting and tensioning a saw chain will be described with reference to FIGS. 1 and 2 of the drawings. Initially the bar 18 is mounted on the studs 28, 30 and is moved toward the sprocket 14. The plate 40 is mounted on the studs 28, 30 adjacent the bar 18 with the fingers 46 fitting in the oil holes 22 of the bar (or such other holes as made available for the purpose). The cam member 50 is mounted on the stud 30 with the cam member 50 positioned so that its peripheral edge will contact the flange 42 of the plate 40.

A nut 34 is loosely fitted on the stud 30 to hold the assembly of the bar 18, the plate 40 and the cam member 50 in position. The saw chain 16 is mounted to encircle the drive sprocket 14 and the guide bar 18 with the drive tangs of the saw chain 16 fitting in the guide groove 24. The cam member 50 is then rotated in the direction indicated by arrow 53 (FIG. 2) by utilizing the slot 56 to force the plate 40 and the guide bar 18 away from the drive sprocket 14. The cam member 50 is rotated until the guide bar 18 has been adjusted to a position to provide the desired tension of the saw chain, (e.g., the chain can be lifted away from the bar edge but without lifting the drive tangs out of the bar groove). As the cam member 50 is rotated, one of the flats 58 will be in abutment with the flange 42 of the plate 40. The nut 34 on the stud 30 is then tensioned to secure the guide bar 18 in the adjusted position. The guide bar 18 is maintained in the adjusted position by the clamping action of the nut 34 and the flat 58 of the cam member 50 in abutment with the flange 42 of the plate 40. The cam member 50 is held in its adjusted position by the clamping action of the nut 34 and further the flat 58 that is in abutment with the flange 42 of the plate 40 resists rotation of the cam member 50 and thus movement of the guide bar 18 toward the drive sprocket 14.

Those skilled in the art will recognize that modifications and variations may be made without departing from the true spirit and scope of the invention. In one such modification, the cam member may be mounted on one stud and the clamping nut on the other stud. The manner of clamping may be other than with threaded inter-engagement of the nut and stud as well. The invention is therefore not to be limited to the embodiments described and illustrated but is to be determined from the appended claims.

We claim:

1. A chain saw comprising:

a chain saw housing, a drive sprocket mounted to the housing and at least one mounting stud affixed to the housing;

a guide bar having a peripheral saw chain guide edge mounted to the mounting stud and thereby positioned relative to the drive sprocket for cooperative mounting and guiding of a saw chain loop along a specified guide path extended from the sprocket and along the guide edge of the guide bar, the guide bar as mounted to the mounting stud permitting a limited range of linear sliding movement of the guide bar toward and away from the sprocket;

an endless saw chain loop having a length that fits the specified guide path within the range of sliding movement of the guide bar;

a clamping member clamping the bar in a fixed position within said range of movement, and said bar provided with a fixed bearing surface positioned adjacent to and spaced from the mounting stud in the direction of sliding movement, and a cam member having a stud receiving opening receiving said mounting stud and a peripheral outer edge portion of the cam member increasing in distance from the opening, said peripheral outer edge portion adapted to engage the bearing surface, and said cam member rotatable on said mounting stud to vary the point of contact as between the peripheral outer edge portion and the bearing surface to produce sliding movement of the bar within said range of movement and thereby a desired tension of the saw chain loop.

2. A chain saw as defined in claim 1 wherein the peripheral outer edge portion is comprised of a sequence of short segments, each segment bounded by edge points between which the bearing surface is seated.

3. A chain saw as defined in claim 2 wherein the short segments are each defined in length by a similar angular span measured from the center of the opening.

4. A chain saw as defined in claim 3 wherein the segments are configured as intersecting flat areas on the peripheral outer edge portion.

5. A chain saw as defined in claim 1 wherein a screwdriver blade receiving slot is provided in the cam member between the opening and the peripheral outer edge portion to facilitate turning of the cam member.

6. A chain saw as defined in claim 1 wherein said mounting stud and a clamping nut are cooperatively threaded to provide said clamping member and to achieve clamping, and wherein the cam member is mounted on said threaded mounting stud and under the clamping nut to be clamped in the desired position for retaining the desired tension of the saw chain loop.

7. A chain saw as defined in claim 1 wherein the cam member is rotated to produce an upward force against the bearing surface to lift the outer end of the bar as permitted by the mounting stud.

* * * * *